US005901794A

United States Patent [19]

Schoeps et al.

[11] Patent Number: 5,901,794

[45] Date of Patent: May 11, 1999

[54] PNEUMATIC POWER WRENCH

[75] Inventors: Knut Christian Schoeps, Tyresö ; Fred Rickard Jonsson, Bandhagen, both of Sweden

[73] Assignee: Atlas Copco Tools AB, Nacka, Sweden

[21] Appl. No.: 08/835,919

[22] Filed: Apr. 10, 1997

[30] Foreign Application Priority Data

Apr. 16, 1996 [SE] Sweden ..... 9601437

[51] Int. Cl.[6] ..... B25B 19/00; B25F 5/02

[52] U.S. Cl. ..... 173/73.5; 173/169; 173/170

[58] Field of Search ..... 173/93, 93.5, 93.6, 173/168, 169, 170, 218, 221, 176, 178

[56] References Cited

U.S. PATENT DOCUMENTS

| | | | |
|---|---|---|---|
| 2,233,163 | 2/1941 | Fosnot | 173/169 |
| 2,405,172 | 8/1946 | Yanchenko | 173/169 |
| 3,228,486 | 1/1966 | Kaman et al. . | |
| 3,299,781 | 1/1967 | Law | 173/169 |
| 3,556,230 | 1/1971 | Roggenburk | 173/177 |
| 3,683,959 | 8/1972 | Tsuji et al. . | |
| 3,924,961 | 12/1975 | Hess et al. | 173/169 |
| 4,016,940 | 4/1977 | Spring, Sr. . | |
| 4,773,487 | 9/1988 | Ringer . | |
| 4,778,015 | 10/1988 | Jacobsson | 173/170 |
| 5,377,769 | 1/1995 | Hasuo et al. | 173/169 |
| 5,531,279 | 7/1996 | Biek | 173/93.5 |
| 5,544,710 | 8/1996 | Groshans et al. | 173/93.5 |
| 5,591,070 | 1/1997 | Kachich | 173/169 |

FOREIGN PATENT DOCUMENTS

| | | |
|---|---|---|
| 0 677 356 A2 | 10/1995 | European Pat. Off. . |
| 23 62 458 A1 | 6/1975 | Germany . |

*Primary Examiner*—Scott A. Smith

*Attorney, Agent, or Firm*—Frishauf, Holtz, Goodman, Langer & Chick

[57] ABSTRACT

A pneumatic power wrench which comprises a rotation motor (11) lodged in a housing (10) having air inlet and outlet passages (16, 23) for communicating air to and from the motor (11), respectively, and a power transmission for connecting the motor (11) to an output shaft (14), wherein the air outlet passage (23) comprises an adjustable air flow restricting mechanism (24) in the form of a valve spindle (29) extending substantially longitudinally through the outlet passage (23), an annular valve seat (34), and a valve element (32) supported on the valve spindle (29) for flow restricting cooperation with the valve seat (34). The valve spindle (29) is axially adjustable relative to the valve seat (34) for varying the flow restriction through the outlet flow restricting mechanism (24).

16 Claims, 2 Drawing Sheets

PNEUMATIC POWER WRENCH

BACKGROUND OF THE INVENTION

This invention relates to a pneumatic power wrench, in particular to a pneumatic power wrench having the specific features stated in the preamble of claim 1.

A general problem concerned with most types of screw joint tightening tools is to actually accomplish the desired pretension level in all joints, irrespectively of difference in torque resistance characteristics of the screw joints. A particular problem of this kind is to avoid undesireable torque overshoot or premature motor shut-off at tightening of stiff or hard joints, depending on whether the wrench is of the stalling type or if it is provided with a retardation responsive shut-off means.

The best way to solve this kind of problem is to reduce the idle or low-load speed of the motor such that the kinetic energy of the rotating parts as well as the retardation magnitude is reduced. A lower kinetic energy adds less tightening torque to the desired target torque level, and lower retardation magnitudes do not cause any premature shut-off in retardation responsive shut-off mechanisms.

One previously known way to solve the above problems is to provide the power wrench with a speed governor which reduces the idle speed level of the motor without impairing the low speed output capacity of the tool. This, however, is a relatively complicated solution to the problem, since it adds a number of details and complicates the power tool design.

Another, simpler and commonly used way to solve this kind of problem is to emplyo a restriction in the pressure air inlet passage to the motor. This results in a reduction of the idle speed of the motor and, accordingly, a reduction in the kinetic energy of the rotating tool parts. However, this solution to the problem also causes a restriction of the low speed power output of the motor, which of course is a disadvantage since the full capacity of the tool is not available.

Still another way of reducing the idle speed of a pneumatic power tool is to restrict the exhaust air outlet flow from the motor. This way is better than restricting the pressure air inlet flow of the motor, because an outlet flow restriction is effective in reducing the idle speed of the motor without impairing the low speed power output of the motor. This is important since it makes it possible to utilize the full capacity of the motor during the final pretensioning phase of a screw tightening process.

SUMMARY OF THE INVENTION

A general object of the invention is to provide a pneumatic power wrench by which the torque overshoot and/or premature shut-off problem is solved by introduction of an outlet flow restricting means, which without having any negative effect on the low speed power output and without complicating the power wrench design effectively reduces the idle speed of the wrench.

A particular object of the invention is to provide a pneumatic power wrench equipped with an outlet flow restriction of a simple and rugged design, and which is easy to adjust.

Other objects and advantages of the invention will appear from the following specification and claims.

Preferred embodiments of the invention are described below with reference to the accompanying drawings.

DESCRIPTION OF THE PREFERRED EMBODIMENT

Figure 1:
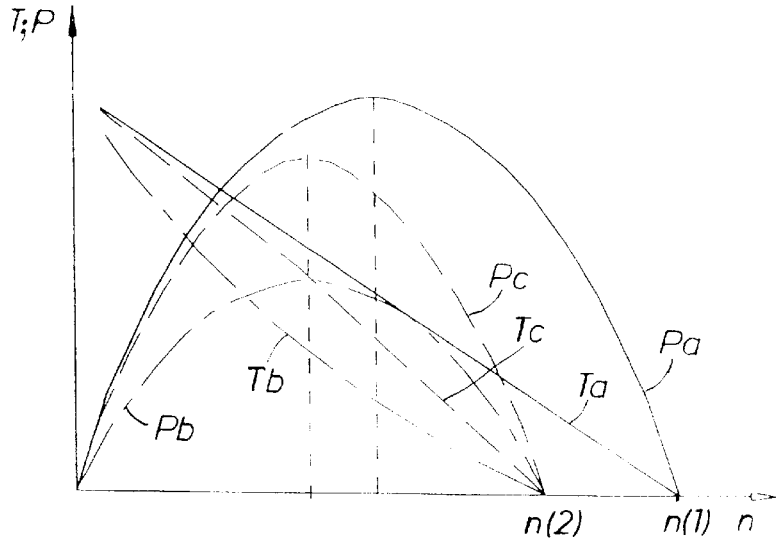
FIG. 1 shows a diagram illustrating the power output characteristics of a power wrench comprising an outlet flow restriction in comparison with the power output characteristics of a tool having an unrestricted pneumatic motor and a tool having an inlet flow restriction.

In the diagram in FIG. 1, the output torque T as well as the output power P of an outlet flow restricted motor are illustrated as functions of rotation speed n. For the purpose of comparison, the diagram also illustrates the output characteristics of an unrestricted tool and a tool having an inlet flow restriction.

The torque/speed characteristic for an unrestricted tool is illustrated as a straight continuous line Ta, and the power/speed characteristic is illustrated by the continuous curve line Pa. The idle or unloaded speed of the unrestricted tool is n(1).

The general aim of the invention is to reduce the idle speed or unloaded speed by 20–25%. This is represented by the point n(2). By employing an inlet type of flow restriction, as commonly used, there is obtained a substantially lowered torque/speed characteristic, as illustrated by the dash dotted line Tb. Compared to the power/speed characteristic Pa of an unrestricted tool, the power/speed characteristic Pb of the inlet restricted tool is substantially reduced too, also in the low speed range.

Accomplishing the same idle speed reduction as by the inlet flow restriction, to point n(2), the outlet flow restriction causes a substantially less torque reduction, as illustrated by the dash line Tc. Typically, an outlet restricted tool provides a much smaller torque reduction than an inlet restricted tool, especially in the low speed range. The same goes for the reduction in output power compared to an unrestricted tool. The power /speed characteristic for an outlet restricted tool is illustrated by the dash line Pc.

One important group of tools to be provided with an outlet flow restricted motor is pneumatic power wrenches having an hydraulic impulse clutch, in particular an impulse clutch of the type without a shunt connection between the pressure chamber compartments. In this type of tools, the first delivered torque impulse tends to have a significantly higher amount of energy due to a higher speed. This means that when tightening a hard screw joint where the torque resistance starts very abruptly, the energy of the first impulse is very high and can easily overtighten the screw joint. Moreover, if this type of tool is provided with a retardation responsive shut-off mechanism, the very first impulse could also cause a premature shut-off of the power supply to the motor.

Figure 2:
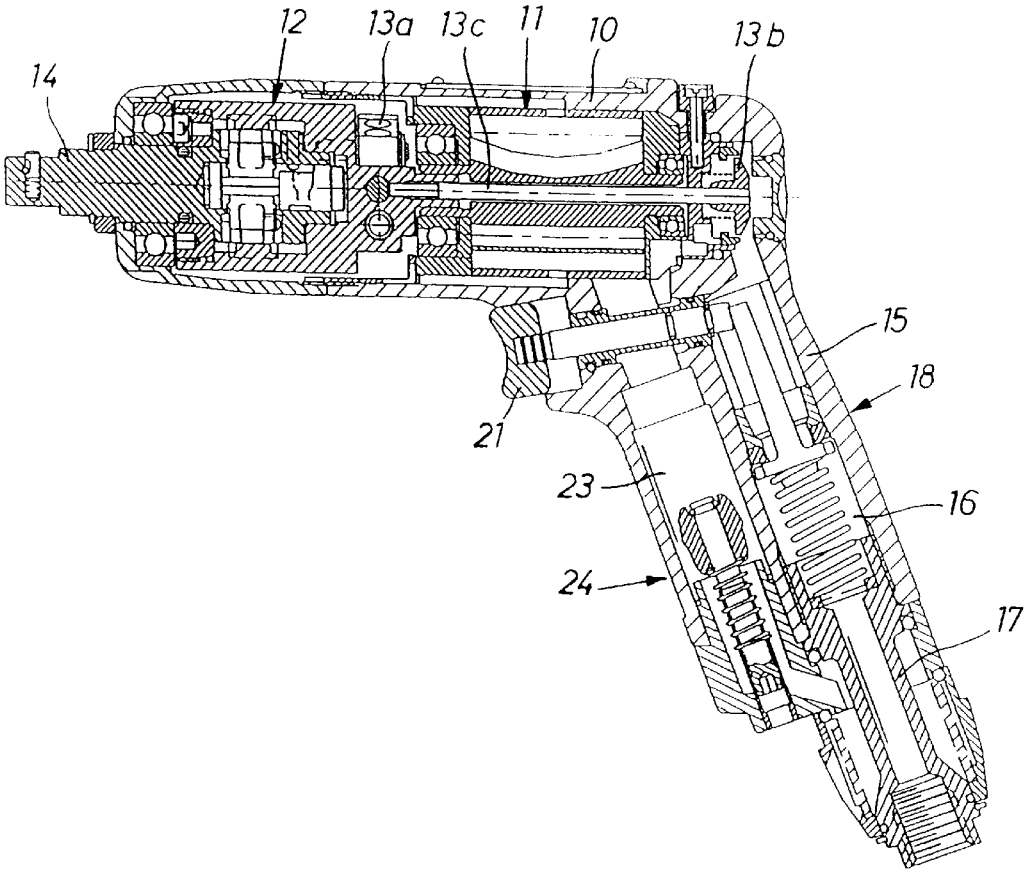
FIG. 2 shows a longitudinal section through a power wrench according to the invention, including the outlet flow restricting means.

Looking now at the embodiments of the invention, FIG. 2 shows a section through a pistol type power wrench comprising a housing 10, a rotation motor 11, a power transmission in the form of a hydraulic torque impulse clutch 12 and an output shaft 14. The impulse clutch 12 is provided with an automatic shut-off means comprising a retardation responsive trigger mechanism 13*a* mounted on the impulse clutch and a pressure air inlet shut-off valve 13*b* located at the rear end of the housing 10. The shut-off valve 13*b* is connected to the trigger mechanism 13*a* via a push rod 13*c* which extends axially through the motor 11.

The shut-off mechanism is previously described in U.S. Pat. No. 5,082,066 granted to applicant.

Moreover, the housing 10 is formed with a pistol type handle 15 which comprises a pressure air inlet passage 16 including an air line connection tube 17, threadingly mounted at the lower end of the handle 15, and a throttle valve 18. The latter comprises a tiltable valve element 19 arranged to sealingly cooperate with a valve seat seal ring 20 and to be operated by a push button 21. A spring 22 takes support against the inner end of the connection tube 17 and biasses the valve element 19 toward closed position.

In parallel with the air inlet passage 16, there is an exhaust air outlet passage 23 which via a flow restricting means 24 and an outlet deflector 25 communicates with the atmosphere. The outlet deflector 25 surrounds an outer portion of the connection tube 11 and is rotatable to enable adjustment of the outlet flow direction.

Attached to the lower part of the handle, there is an end piece 27 through which extends an axial bore 28 and a threaded valve spindle 29. The thread on the latter engages a threaded sleeve 30 rigidly secured in the end piece 27, and by means of an internal screw bit grip 31 in the spindle 29, the latter is rotatble to adjust its axial position in relation to the end piece 27. On the inner end of the spindle 29, there is supported a valve element 32 which is formed with a conical portion 33 for sealing cooperation with an annular seat 34 formed by the inner end of the end piece 27. A lock ring 35 is mounted in a circumferential groove 36 on the spindle 29 to form an axial lock means for the valve element 32.

The valve element 32 is movably guided on the spindle 29 between a shoulder 37 on the spindle 29 and the lock ring 35. A spring 38 acts between the inner end of the sleeve 30 and the valve element 32 to bias the latter toward the lock ring 35. In this way, the valve element 32 is displaceable between a maximum flow position defined by the lock ring 35 and a minimum flow position defined by the shoulder 37.

In the innermost position of the valve element 32, which is defined by the lock ring 35 and which is illustrated in FIG. 2, the flow restriction opening has its maximum size. This position is adjustable by means of the threaded spindle 29. At high speed operation of the tool, the outlet flow is high and the pressure drop across the valve element 32 will make the latter move against the force of the spring 38. Thereby, the valve element 32 will occupy its minimum flow position to restrict the outlet flow and limit the idle speed of the tool. The minimum flow position is defined by the shoulder 37 on the spindle 29.

In operation of the power tool, the valve spindle 25 is set to accomplish a flow restricting passage between the valve element 26 and the seat 27 that is adeqate in relation to the desired idle speed. The setting of the restriction valve 26 may be adjusted to adapt the output characteristics of the tool to the actual screw joint chacteristics.

Figure 3:
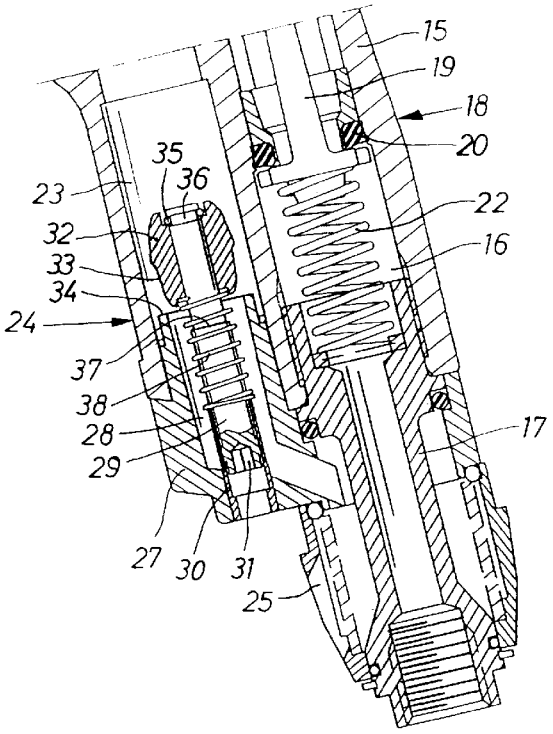
FIG. 3 shows, on a larger scale, a section through the handle of the power wrench illustrating the outlet flow restriction.
Figure 4:
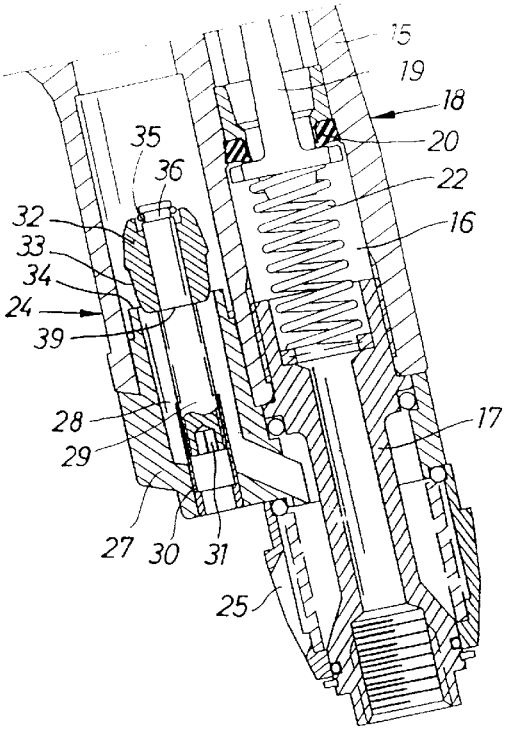
FIG. 4 shows, on a larger scale like FIG. 3, a section through the handle of the power wrench and illustrates an alternatively designed outlet flow restricting means.

The spring biassed outlet flow restricting valve as illustrated in FIG. 3 is effctive in accomplishing an even smaller power loss at low speed operation of the tool, although maintaining a favourable idle speed reduction.

In FIG. 3, there is illustrated an alternative and even simpler design of the outlet flow restriction 24. In this embodiment of the invention, the valve element 32 is rigidly secured to the spindle 29 and does not adjust automatically to the actual air flow. The valve element 32 is immovably locked between a shoulder 39 on the spindle 29 and the lock ring 35.

We claim:

1. Pneumatic power wrench, comprising a housing (10), a rotation motor (11), an output shaft (14) for connection to a screw joint to be tightened, a power transmission (12) connecting said motor (11) to said output shaft (14), a pressure air inlet passage (16), and an exhaust air outlet passage (23) which comprises an adjustable flow restricting means (24) for limiting the low-load motor speed, characterized in that said flow restricting means (24) comprises a valve spindle (29) extending substantially longitudinally through said outlet passage (23), a valve seat (34) formed by an annular shoulder in said outlet passage (23), and a valve element (32) supported on said valve spindle (29) and arranged to cooperate with said valve seat (34), wherein said valve spindle (29) is axially adjustable relative to said valve seat (34) for varying the flow restriction of said flow restricting means (24).

2. Power wrench according to claim 1, wherein said valve element (32) is rigidly secured to said valve spindle (29).

3. Power wrench according to claim 2, wherein said valve spindle (29) is formed both with a thread for engagement wit ha threaded bore (30) in said housing (10) and with a screw bit grip (31), whereby said valve spindle (29) is longitudinally adjustable.

4. Power wrench according to claim 3, wherein said power transmission (12) comprises a hydraulic impulse clutch for connecting intermittently said motor (11) to said output shaft (14).

5. Power wrench according to claim 2, wherein said power transmission (12) comprises a hydraulic impulse clutch for connecting intermittently said motor (11) to said output shaft (14).

6. Power wrench according to claim 1, wherein said valve element (32) is movably guided on said valve spindle (29) between a predetermined minimum flow position and a predetermined maximum flow position, and a spring means (38) is arranged to bias said valve element (32) toward said maximum flow position.

7. Power wrench according to claim 6, wherein said minimum flow position and said maximum flow position of said valve element (32) are defined by two axially spaced shoulders (35,37) on said valve spindle (29).

8. Power wrench according to claim 7, wherein said valve spindle (29) is formed both with a thread for engagement with a threaded bore (30) in said housing (10) and with a screw bit grip (31), whereby said valve spindle (29) is longitudinally adjustable.

9. Power wrench according to claim 8, wherein said power transmission (12) comprises a hydraulic impulse clutch for connecting intermittently said motor (11) to said output shaft (14).

10. Power wrench according to claim 7, wherein said power transmission (12) comprises a hydraulic impulse clutch for connecting intermittently said motor (11) to said output shaft (14).

11. Power wrench according to claim 6, wherein said valve spindle (29) is formed both with a thread for engagement with a threaded bore (30) in said housing (10) and with a screw bit grip (31), whereby said valve spindle (29) is longitudinally adjustable.

12. Power wrench according to claim 11, wherein said power transmission (12) comprises a hydraulic impulse clutch for connecting intermittently said motor (11) to said output shaft (14).

13. Power wrench according to claim 6, wherein said power transmission (12) comprises a hydraulic impulse clutch for connecting intermittently said motor (11) to said output shaft (14).

14. Power wrench according to claim 1, wherein said valve spindle (29) is formed both with a thread for engagement with a threaded bore (30) in said housing (10) and with a screw bit grip (31), whereby said valve spindle (29) is longitudinally adjustable.

15. Power wrench according to claim 14, wherein said power transmission (12) comprises a hydraulic impulse clutch for connecting intermittently said motor (11) to said output shaft (14).

16. Power wrench according to claim 1, wherein said power transmission (12) comprises a hydraulic impulse clutch for connecting intermittently said motor (11) to said output shaft (14).

* * * * *